US005933510A

United States Patent [19]

Bryant et al.

[11] Patent Number: 5,933,510

[45] Date of Patent: Aug. 3, 1999

[54] USER SELECTABLE UNIDIRECTIONAL/ OMNIDIRECTIONAL MICROPHONE HOUSING

[75] Inventors: David E. Bryant; Daniel Bryan Kelly, both of Austin, Tex.

[73] Assignee: Siemens Information and Communication Networks, Inc., Boca Raton, Fla.

[21] Appl. No.: 08/942,974

[22] Filed: Oct. 2, 1997

[51] Int. Cl.[6] ..... H04R 25/00

[52] U.S. Cl. ..... 381/356; 381/313; 381/355

[58] Field of Search ..... 381/153, 155, 381/168, 169, 68.1, 313, 337, 356, 357, 358, 387, 355, 322, FOR 128, FOR 142, FOR 147, FOR 148

[56] References Cited

U.S. PATENT DOCUMENTS 3,876,843 4/1975 Moen ..... 381/68.1

4,142,072 2/1979 Berland ..... 381/68.1

*Primary Examiner*—Huyen Le

[57] ABSTRACT

A housing (100) for a unidirectional microphone (102) is described which has an enclosure (104, 106) for holding the unidirectional microphone. The enclosure has a first plurality of apertures (108, 110, 114) for transmitting acoustic energy to the front and back of the unidirectional microphone. An assembly (116) is movably coupled to the enclosure which, in a first position, facilitates transmission of acoustic energy to both the front and the back of the unidirectional microphone via a first subset of the first plurality of apertures thereby facilitating unidirectional operation. In a second position the assembly inhibits transmission of acoustic energy to the back of the unidirectional microphone by blocking a second subset of the plurality of apertures thereby facilitating omnidirectional operation.

7 Claims, 3 Drawing Sheets

USER SELECTABLE UNIDIRECTIONAL/ OMNIDIRECTIONAL MICROPHONE HOUSING

BACKGROUND OF THE INVENTION

The present invention relates to acoustic technology. More specifically, the present invention relates to a microphone which may be configured by the user for both unidirectional and omnidirectional operation.

Speaker phones employ a microphone and a loudspeaker to allow a single user to engage in a telephone conversation with his hands free, or to allow several people in one location to participate in a conversation using a single phone. Such phones typically incorporate a particular type of microphone depending upon the application for which they are intended. For example, a speaker phone intended for use by a single person typically employs a unidirectional microphone which is designed to pick up acoustic energy from the hemisphere in front of the microphone much more efficiently than from the hemisphere behind the microphone. This reduces the room echo which often results in the impression that the user is speaking from a barrel. Moreover, by properly positioning the unidirectional microphone, coupling from the loudspeaker and the resultant instability are reduced.

In contrast, a speaker phone intended for conferencing must be able to pick up acoustic energy from several different vantage points such as, e.g., from several people seated around a conference table. Therefore, such phones typically employ multiple unidirectional microphones pointed in different directions. However, while these microphones may be positioned to reduce loudspeaker coupling as mentioned above, sound performance is degraded by room echo which is picked up by opposing microphones. Moreover, having multiple microphones increases the cost of such phones undesirably.

It is therefore desirable to provide a less expensive alternative to the multiple microphone speaker phone which realizes the performance advantages of the single unidirectional microphone device when employed by a single user and which also is capable of being employed in the conferencing context.

SUMMARY OF THE INVENTION

According to the present invention, a microphone housing is provided which allows the user to select the directional characteristic of the microphone assembly to be either unidirectional or omnidirectional. The housing may be manipulated by the user to open and close ports in the housing which transmit acoustic energy into cavities in front and in back of a unidirectional microphone. In a first configuration, the port to the cavity behind the unidirectional microphone is closed thereby configuring the device for omnidirectional operation. That is, acoustic energy is received and processed by the unidirectional microphone roughly equally from opposing hemispheres without cancellation of the energy originating from behind the microphone. This occurs because a unidirectional microphone requires information about the relative phases of energy received at the front and back of the microphone to facilitate unidirectional operation. Because no energy reaches the back of the microphone in this configuration, the microphone does not have the necessary phase information to cancel the energy from any particular direction and therefore does not cancel out energy from any direction.

In a second configuration, ports at both ends of the housing are open thereby configuring the device for unidirectional operation. That is, acoustic energy is received at the front and back of the microphone thereby providing the necessary phase information for cancellation of acoustic energy coming from behind the microphone.

Thus, the present invention provides a housing for a unidirectional microphone having an enclosure for holding the unidirectional microphone. The enclosure has a first plurality of apertures for transmitting acoustic energy to the front and back of the unidirectional microphone. An assembly is movably coupled to the enclosure which, in a first position, facilitates transmission of acoustic energy to both the front and the back of the unidirectional microphone via a first subset of the first plurality of apertures thereby facilitating unidirectional operation. In a second position the assembly inhibits transmission of acoustic energy to the back of the unidirectional microphone by blocking a second subset of the plurality of apertures thereby facilitating omnidirectional operation. According to a specific embodiment, the assembly comprises a second plurality of apertures and is disposed adjacent the enclosure and is operable to move relative to the enclosure, thereby aligning selected ones of the first and second pluralities of apertures.

A further understanding of the nature and advantages of the present invention may be realized by reference to the remaining portions of the specification and the drawings.

DESCRIPTION OF A SPECIFIC EMBODIMENT

Figure 1:
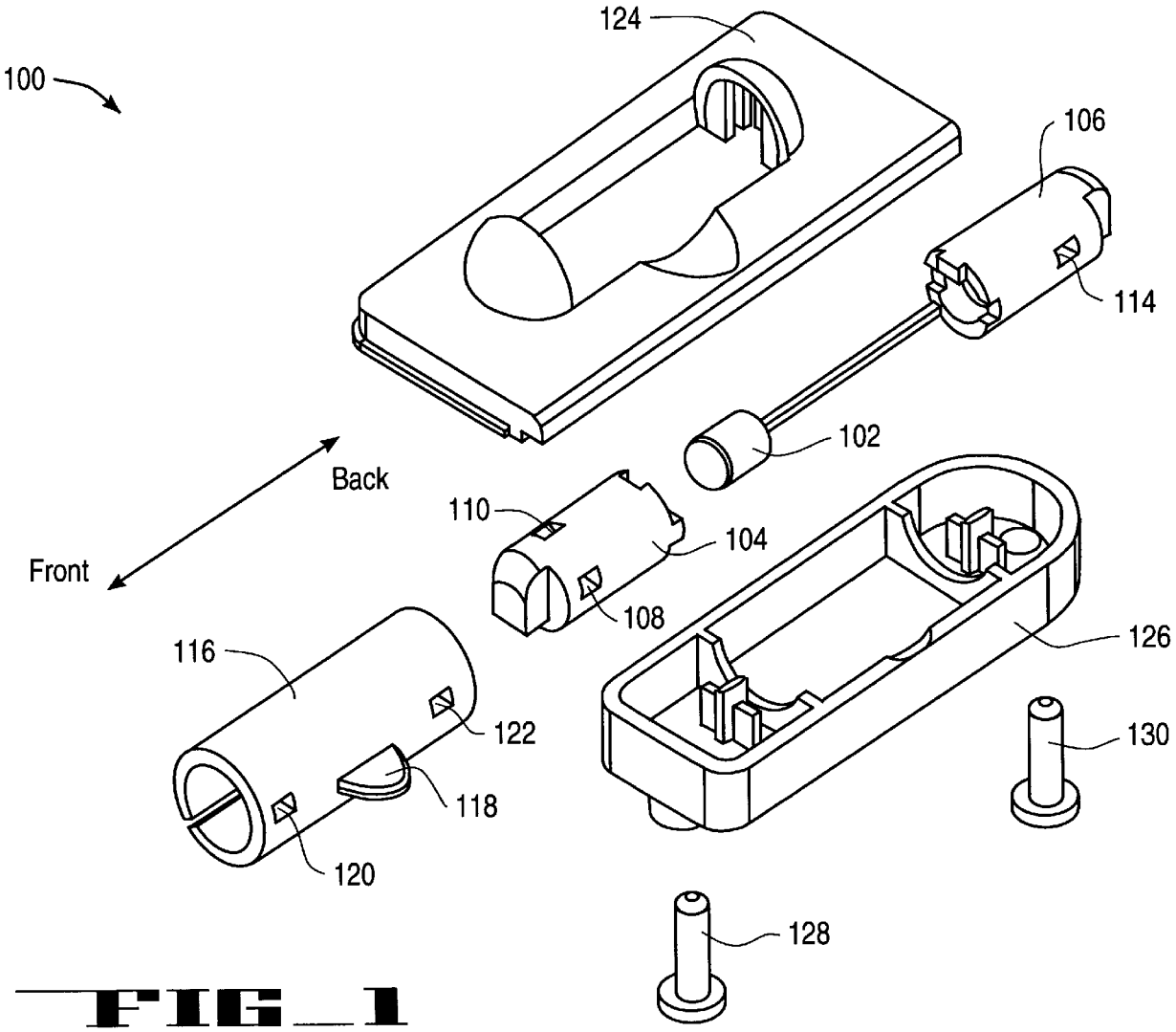
FIG. 1 is an exploded perspective view of a specific embodiment of the present invention.

FIG. 1 is an exploded perspective view of a microphone housing 100 designed according to a specific embodiment of the present invention. A microphone 102 fits into an enclosure assembly comprising enclosure parts 104 and 106 such that cavities are provided within the assembly to the front and to the rear of microphone 102. Enclosure part 104 has two apertures 108 and 110 which allow transmission of acoustic energy to the cavity in front of microphone 102. Enclosure part 106 has a single aperture 114 which allows transmission of acoustic energy to the cavity behind microphone 102. The front and back of microphone housing 100 are as indicated. A single user would sit in front of the housing and configure it for unidirectional operation.

A sleeve assembly 116 fits snugly around the enclosure assembly and may be manually rotated relative thereto by manipulation of protruding member 118. Sleeve assembly 116 includes apertures 120 and 122 at opposing ends of the assembly. When sleeve assembly 116 is placed in a first position with respect to the enclosure assembly (i.e., assembled parts 104 and 106), apertures 120 and 122 line up with apertures 108 and 114, respectively, thereby allowing transmission of acoustic energy into both the front and rear cavities adjacent unidirectional microphone 102. When sleeve assembly is placed in a second position with respect to the enclosure assembly, aperture 120 aligns with aperture 110, thereby allowing transmission of acoustic energy into only the front cavity of the enclosure assembly. In this configuration, aperture 122 opens only onto the surface of enclosure part 106 and, because of the snug fit between the assemblies, virtually no acoustic energy reaches the back of microphone 102 via aperture 122. Assembled parts 102, 104, 106 and 116 are disposed within an outer enclosure comprising outer enclosure parts 124 and 126 which are secured together with screws 128 and 130.

Figure 2:
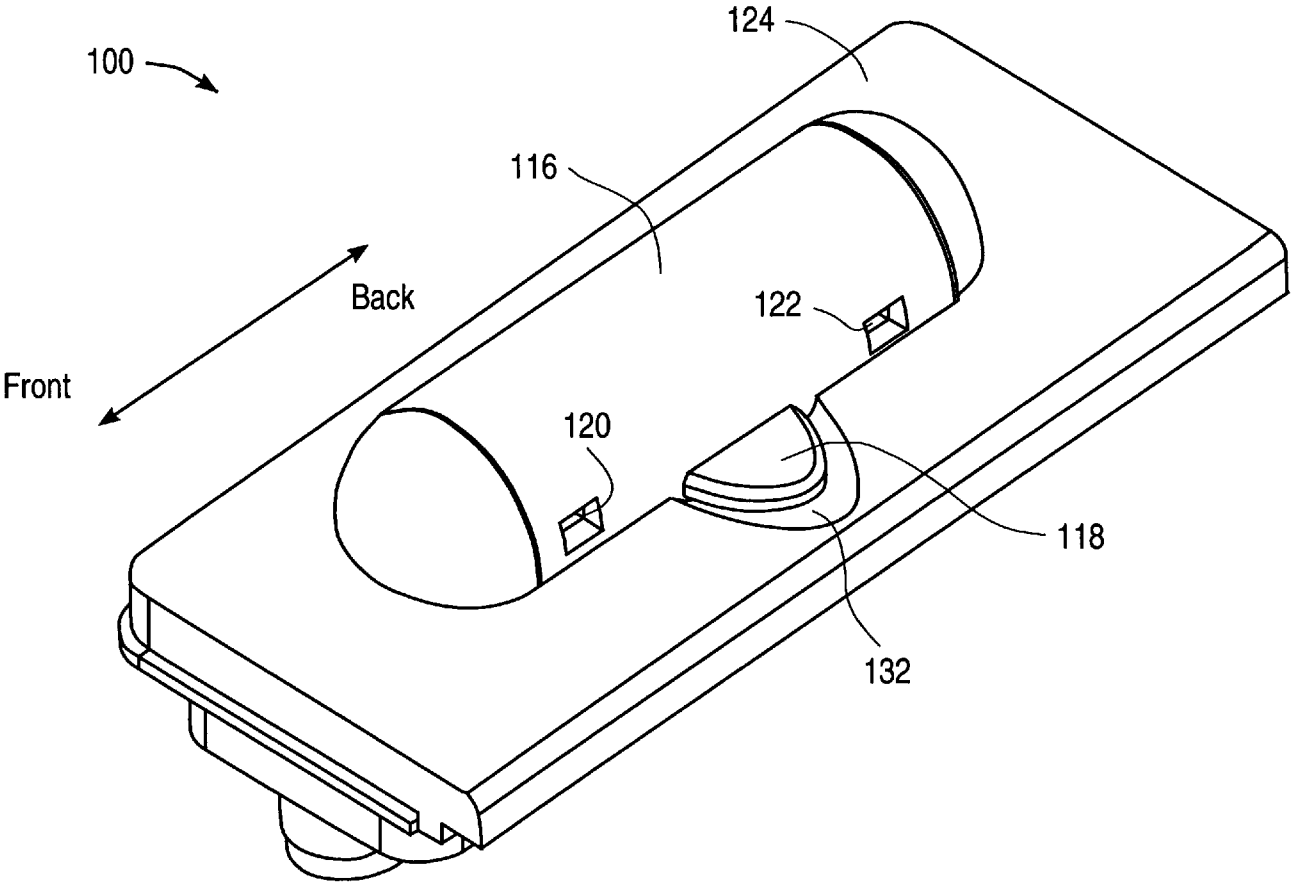
FIG. 2 is a perspective view of a specific embodiment of the present invention configured for unidirectional operation.

FIG. 2 is a perspective view of microphone housing 100 configured for unidirectional operation. In this configuration, apertures 120 and 122 of sleeve assembly 116 are aligned with apertures 108 and 114 (not shown) as discussed above. Member 118 fits into depression 132 in outer enclosure part 124. Acoustic energy is therefore received at both the front and back of microphone 102. Using the relative phase information of energy received from the front and back, microphone 102 cancels acoustic energy received from behind microphone housing 100 thereby providing for unidirectional operation.

Figure 3:
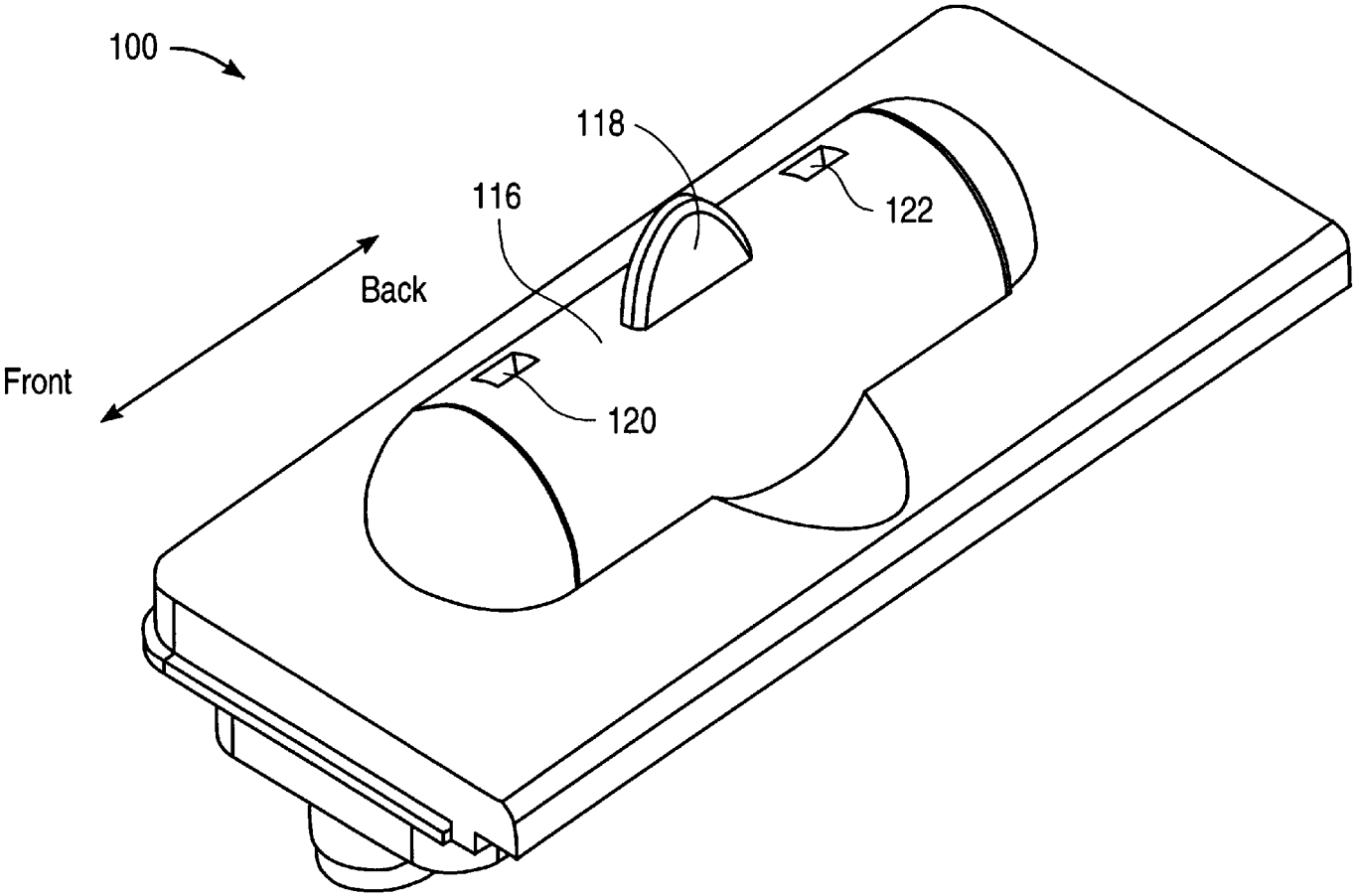
FIG. 3 is a perspective view of a specific embodiment of the present invention configured for omnidirectional operation.

FIG. 3 is a perspective view of microphone housing 100 configured for omnidirectional operation. In this configuration, sleeve assembly 116 has been rotated about its longitudinal axis by approximately 90 degrees from the position shown in FIG. 2 via manipulation of member 118 thereby aligning aperture 120 with aperture 110 (not shown) as discussed above. In this position, aperture 122 is no longer aligned with aperture 114 and acoustic energy is only received at the front of microphone 102. Without the relative phase information from energy received at the back of the microphone, microphone 102 acts like an omnidirectional microphone, processing acoustic energy roughly equally from all directions.

While the invention has been particularly shown and described with reference to specific embodiments thereof, it will be understood by those skilled in the art that changes in the form and details of the disclosed embodiments may be made without departing from the spirit or scope of the invention. For example, rather than providing two openings in the inner enclosure to the front cavity adjacent the microphone as described above with reference to FIG. 1 (i.e., apertures 108 and 114), a single aperture may be provided which is large enough to allow transmission of acoustic energy to the microphone when the aperture in the outer enclosure (i.e., 120) is in either position. In addition, the relative motion between the assemblies may be provided by movement of either the inner or the outer assembly. Moreover, a single aperture could be provided into each of the cavities in front and behind the microphone. In such an embodiment, the rear aperture would be opened and closed independently of the front aperture. Therefore, because the present invention may be implemented in a wide variety of ways, the scope of the invention should be determined with reference to the appended claims.

What is claimed is:

1. A housing for a unidirectional microphone, the unidirectional microphone having a front and a back, the housing comprising:

a cylindrical enclosure for holding the unidirectional microphone, the cylindrical enclosure having a first plurality of apertures for transmitting acoustic energy to the front and back of the unidirectional microphone; and a cylindrical assembly enclosing the cylindrical enclosure and operable to rotate relative thereto which, in a first position, facilitates transmission of acoustic energy to both the front and the back of the unidirectional microphone via a first subset of the first plurality of apertures thereby facilitating unidirectional operation, and which, in a second position inhibits transmission of acoustic energy to the back of the unidirectional microphone by blocking a second subset of the plurality of apertures thereby facilitating omnidirectional operation.

2. The housing of claim 1 wherein:

the first plurality of apertures comprises first and second apertures for transmitting acoustic energy to the front of the unidirectional microphone, and a third aperture for transmitting acoustic energy to the back of the unidirectional microphone;

wherein the first position of the cylindrical assembly allows transmission of acoustic energy to the front and back of the unidirectional microphone via the first and third apertures; and wherein the second position of the cylindrical assembly allows transmission of acoustic energy to the front of the unidirectional microphone via the second aperture.

3. The housing of claim 1 wherein:

the first plurality of apertures comprises a first aperture for transmitting acoustic energy to the front of the unidirectional microphone, and a second aperture for transmitting acoustic energy to the back of the unidirectional microphone;

wherein the first position of the cylindrical assembly allows transmission of acoustic energy to the front and back of the unidirectional microphone via the first and second apertures; and wherein the second position of the cylindrical assembly allows transmission of acoustic energy to the front of the unidirectional microphone via the first aperture.

4. The housing of claim 1 wherein the cylindrical assembly comprises a second plurality of apertures and is disposed adjacent the cylindrical enclosure and is operable to move relative to the cylindrical enclosure, thereby aligning selected ones of the first and second pluralities of apertures.

5. The housing of claim 1 wherein the cylindrical assembly is disposed outside of the cylindrical enclosure.

6. The housing of claim 1 wherein relative motion between the cylindrical assembly and the cylindrical enclosure is achieved by manipulation of the cylindrical assembly.

7. A housing for a unidirectional microphone, the unidirectional microphone having a front and a back, the housing comprising:

a cylindrical enclosure for holding the microphone, the cylindrical enclosure having a first plurality of apertures for transmitting acoustic energy to the front and the back of the unidirectional microphone; and a cylindrical assembly comprising a second plurality of apertures, the cylindrical assembly enclosing the cylindrical enclosure and being operable to rotate relative to the cylindrical enclosure and to thereby align selected ones of the first and second pluralities of apertures;

wherein when the cylindrical assembly is in a first position relative to the cylindrical enclosure, acoustic energy is transmitted to the front and the back of the unidirectional microphone thereby facilitating unidirectional operation, and wherein when the cylindrical assembly is in a second position relative to the cylindrical enclosure, transmission of acoustic energy to the back of the unidirectional microphone is inhibited thereby facilitating omnidirectional operation.

* * * * *